US006802081B1

(12) United States Patent
Ogino et al.

(10) Patent No.: US 6,802,081 B1
(45) Date of Patent: Oct. 12, 2004

(54) MOISTURE ABSORBING/RELEASING AND HEAT GENERATING INNER CLOTH AND METHOD OF PRODUCING IT AND MOISTURE ABSORBING/RELEASING, HEAT GENERATING AND HEAT-RETAINING ARTICLES

(75) Inventors: Takeshi Ogino, Osaka (JP); Shigeru Aoyama, Osaka (JP)

(73) Assignee: Mizuno Corporation, Osaka (JP)

( * ) Notice: Subject to any disclaimer, the term of this patent is extended or adjusted under 35 U.S.C. 154(b) by 0 days.

(21) Appl. No.: 09/485,675

(22) PCT Filed: Jun. 24, 1998

(86) PCT No.: PCT/JP99/02827

§ 371 (c)(1),
(2), (4) Date: Feb. 24, 2000

(87) PCT Pub. No.: WO99/67455

PCT Pub. Date: Dec. 29, 1999

(51) Int. Cl.[7] ..... A41B 00/00; A41D 00/00
(52) U.S. Cl. ..... 2/69; 2/69.5; 2/97; 2/164
(58) Field of Search ..... 2/69.5

(56) References Cited

U.S. PATENT DOCUMENTS 5,112,684 A * 5/1992 Halm et al. ..... 428/357
6,112,328 A * 9/2000 Spector ..... 2/269

FOREIGN PATENT DOCUMENTS

| | | | | |
|---|---|---|---|---|
| GB | 2000440 A | * | 1/1979 | ..... D04H/13/00 |
| GB | 2 000 440 A | | 1/1979 | |
| JP | 4011014 | | 1/1992 | |
| JP | 06294006 A | * | 10/1994 | ..... A41D/31/02 |
| JP | 8158124 | | 6/1998 | |

* cited by examiner

*Primary Examiner*—Glenn Caldarola
*Assistant Examiner*—Alexis Wachtel
(74) *Attorney, Agent, or Firm*—Heller Ehrman White and McAuliffe LLP

(57) ABSTRACT

The moisture-absorbent/releasable heat-generating intermediate material of the present invention is inserted between an outer material and a lining, both having a moisture-permeable/waterproof property, a windproof property and other desired properties, thereby constituting a heat-retaining article. It comprises a blend of a heat-retaining fiber including an air layer of not less than 50 ml per 1 gram and a moisture-absorbent/releasable heat-generating fiber. The moisture-absorbent/releasable heat-generating fiber generates heat by absorbing moisture in a vapor phase or in a liquid phase discharged from a human body and an immobile air layer formed by the heat-retaining fiber retains the heat.

20 Claims, 9 Drawing Sheets

(a)

(b)

(c)

MOISTURE ABSORBING/RELEASING AND HEAT GENERATING INNER CLOTH AND METHOD OF PRODUCING IT AND MOISTURE ABSORBING/RELEASING, HEAT GENERATING AND HEAT-RETAINING ARTICLES

TECHNICAL FIELD

The present invention relates to clothes, caps, shoes, bedclothes and bedding, and other various articles to be put on humans. More specifically, it relates to moisture-absorbent/releasable heat-generating heat-retaining articles which develop a heat-generating property by absorbing moisture, an intermediate material used therefor, and a method for producing the intermediate material.

BACKGROUND ART

Conventionally, heat-retaining articles such as clothes, bedclothes and bedding which require a heat-retaining property have generally utilised feather as an intermediate material.

Recently, Japanese Patent No. 2028467 discloses a heat-retaining article using a moisture-absorbent/releasable heat-generating fiber as an intermediate material, which generates heat by absorbing moisture in the vapor phase or the liquid phase discharged from the human body.

The former prior art has provided feather products which are employed under a generic name down. However, when used for sports clothes for skiing, mountaineering, etc., they suffer from dampness, because feather does not have an appreciable moisture-absorbency on its own.

Besides, in such feather products, heat is not generated by the feather on its own. Rather, they retain body heat without a loss in an immobile air layer, which is attributable to a high bulkiness (air content) peculiar to feather and which is secured within an intermediate material itself to impart a heat insulation effect. Inevitably, a feather product with an excellent heat-retaining property employs a greater amount of feather and becomes bulkier as a whole.

On the other hand, according to the latter prior art, the moisture-absorbent/releasable heat-generating heat-retaining articles which utilise a moisture-absorbent/releasable heat-generating fiber are lacking in bulkiness (air content) equivalent to that of feather. To our inconvenience, even when the moisture-absorbent/releasable heat-generating fiber generates heat by absorbing moisture in the vapor phase or in the liquid phase discharged from a human body, it cannot hold the heat without a loss.

Besides, this moisture-absorbent/releasable heat-generating fiber absorbs and releases moisture, not only in a large amount but also at a fast rate. Therefore, the fiber weight is unstable and varies to about twice its weight, depending on the moisture-absorption/release conditions of the moment. Nonetheless, in the factories where such a moisture-absorbent/releasable heat-generating fiber is handled, the fiber is usually handled under a humidified atmosphere for the purpose of avoiding generation of static electricity. This only increases a factor of destabilising the fiber weight. To our inconvenience, it is therefore impossible to blend a moisture-absorbent/releasable heat-generating fiber with a fiber of another species at a stable blending ratio.

The present invention has been made in view of these circumstances and intends to provide a moisture-absorbent/releasable heat-generating intermediate material, which is capable of optimising the function of a moisture-absorbent/releasable heat-generating fiber, a method for producing the same, and a moisture-absorbent/releasable heat-generating heat-retaining article using the intermediate material.

DISCLOSURE OF THE INVENTION

In order to achieve the above objects, a moisture-absorbent/releasable heat-generating intermediate material of the present invention is inserted between an outer material and a lining, both having a moisture-permeable/waterproof property, a windproof property and other desired properties, thereby to constitute a heat-retaining article, wherein the intermediate material comprises a heat-retaining fiber including an air layer of not less than 50 ml per 1 gram and a moisture-absorbent/releasable heat-generating fiber, each being dried to an inherent minimum moisture content and prepared in a prescribed weight ratio, and wherein the moisture-absorbent/releasable heat-generating fiber is homogeneously blended and dispersed in the heat-retaining fiber, whereby the moisture-absorbent/releasable heat-generating fiber generates heat by absorbing moisture in a vapor phase or in a liquid phase discharged from a human body, and an immobile air layer formed by the heat-retaining fiber retains the heat.

Since the outer material and the lining applied to the present invention only need to have a moisture-permeable/waterproof property, a windproof property and other desired properties, their materials are not limited strictly. A variety of materials can be used including polyesters, nylons, acrylic fibers, polypropylenes, polyvinyl chloride, polyurethane, rayon, acetate and other chemical fibers; wool, cotton and other natural fibers; natural leather, artificial leather and synthetic leather, and the like. Likewise, there is no strict limitation as to the form of the outer material and the lining. A material may be worked into woven fabric, knitted fabric, non-woven fabric, felt, sheet and film, or may be employed in an unprocessed state.

As for the heat-retaining fibers of the present invention including an air layer of not less than 50 ml per 1 gram, there may be natural fibers including sheep wools, animal wools, clothing wools (merino wool, Corriedale wool, Leicester wool), goat wools (mohair, cashmere, goat wool), camel wools (camel wool, llama wool, alpaca wool, vicuna wool), others (angora rabbit hair), silks (cultivated silk, wild silk), feathers, etc. Further, there may be bulky processed fibers such as hollow fibers, multilobal cross-section fibers and ultra-thin fibers including conjucate fiber. Examples of these heat-retaining fiber products are Dacron (manufactured by Du Pont de Nemours and Company, trade name), Hollofil (manufactured by Du Pont de Nemours and Company, trade name), Thermolite (manufactured by Du Pont de Nemours and Company, trade name), Shrape (manufactured by Toyobo Co., Ltd., trade name), etc.

As for the moisture-absorbent/releasable heat-generating fiber of the present invention, there are mentioned blends of various fiber materials and fine powders of a desiccant which generates absorptive heat in absorbing moisture or water, examples of which include synthetic silica gel, natural silica-alumina-series desiccants, and ceramic-series desiccants such as molecular sieves, etc., and there may also be crosslinked acrylic fibers. The crosslinked acrylic fiber used herein is a fiber comprising an acrylonitrile-series polymer containing 40% by weight or more, preferably 50% by weight or more, of acrylonitrile (hereinafter mentioned as AN) as a starting fiber. It is applicable in the form of staple, tow, yarn, knitted/woven fabric, non-woven fabric, etc.

Intermediate fibers obtained in the production process, waste fibers or the like are also applicable. Due to the necessity of the subsequent cutting step, it is preferable that an acrylic tow has 0.1 to 50 denier as the single yarn denier and 1,000,000 to 3,000,000 denier as the total yarn denier.

The AN-series polymer may be either of AN homopolymers or AN copolymers with monomers of other species. The monomers of other species are not particularly limited, so long as they are copolymerizable with AN. Examples of these monomers may include vinyl halides and vinylidene halides; acrylic esters; sulfonic group-containing monomers and salts thereof, such as methallyl sulfonic acid and p-styrenesulfonic acid; carboxylic group-containing monomers and salts thereof, such as methacrylic acid and itaconic acid; and other monomers such as acrylamide, styrene and vinyl acetate.

A process applied herein comprises introducing a hydrazine compound, as a crosslinking agent, into the above acrylic fibers. In an industrially preferable process, treatment is conducted within five hours, with the nitrogen content increase adjusted to 1.0 to 10.0% by weight, in a hydrazine compound concentration of 5 to 60% at 50 to 120° C. Herein, the nitrogen content increase refers to a difference in nitrogen content between the starting acrylic fibers and the acrylic fibers introduced with a hydrazine compound as a crosslinking agent. Where the nitrogen content increase is below the above-specified lower limit (1.0% by weight), resulting fibers have neither satisfactory physical properties nor such characteristics as flame retardancy and antibacterial properties. On the other hand, where the nitrogen content increase exceeds the above-specified upper limit (10.0% by weight), high moisture-absorbency/releasability is sacrificed. Therefore, if the nitrogen content increase stays within the above-specified range, the hydrazine compound used herein is not particularly limited. Examples of the hydrazine compounds may include hydrazine hydrate, hydrazine sulfate, hydrazine hydrochloride, hydrazine hydrobromide and hydrazine carbonate, and may further include compounds containing two or more amine groups, such as ethylenediamine, guanidine sulfate, guanidine hydrochloride, guanidine phosphate and melanin.

Incidentally, this crosslinking step applies a process comprising substantially removing, by hydrolysis, the nitrile groups remaining uncrosslinked after the crosslinking treatment with a hydrazine compound, and introducing 1.0 to 4.5 meq/g of salt type carboxyl groups and amido groups into the remaining parts. The process used therefor may comprise heat treatment of starting fibers impregnated with or dipped into aqueous basic solutions of alkali metal hydroxides, ammonia or the like, or aqueous solutions of mineral acids such as nitric acid, sulfuric acid or hydrochloric acid. Alternatively, hydrolysis may be carried out at the same time as the introduction of the above crosslinking agent. When hydrolysis is carried out with an acid, the carboxyl groups need to be converted to those of the salt type.

The thus obtained moisture-absorbent/releasable heat-generating fiber exhibits a tensile strength of not less than 1 g/d, and not less than 1.5 g/d under preferable conditions. Further, it absorbs and releases moisture at a fast rate, shows an excellent moisture-absorbency/releasability and moisture-absorbing/heat-generating property, and possesses antibacterial properties and flame retardancy.

In the moisture-absorbent/releasable heat-generating intermediate material of the present invention, the moisture-absorbent/releasable heat-generating fiber and the heat-retaining fiber should be prepared, each in a dried state, in a prescribed weight ratio. Since the moisture-absorbent/releasable heat-generating fiber, in particular, absorbs and releases moisture, not only in a large amount but also at a fast rate, its weight varies too drastically in a normal atmosphere to stabilise the weight ratio, with respect to the heat-retaining fiber. In other words, this moisture-absorbent/releasable heat-generating fiber releases a large amount of moisture at a fast release rate, as mentioned above. Accordingly, when dried in a drying furnace or the like, it can be dried in a short time about between a few minutes and an hour. Besides, the thus dried moisture-absorbent/releasable heat-generating fiber is not dried any further than the minimum moisture content which is inherent in the fiber, unless vacuum drying or like operation is conducted. In another aspect, the dried moisture-absorbent/releasable heat-generating fiber absorbs a large amount of moisture at a fast absorption rate, as mentioned above. As a result, depending on the handling immediately after drying, it may increase its weight by absorbing moisture. In order to prevent the moisture-absorbent/releasable heat-generating fiber, which has just been dried, from excessive manifestation of the moisture-absorbing capacity, it is required to lower the relative humidity by sufficient dry-air cooling. At the same time, the moisture-absorbent/releasable heat-generating fiber, on its own, is compressed to reduce its surface area where the fiber contacts with air, so as to inhibit increase of its moisture-absorbing capacity. After this condition is achieved, the heat-retaining fiber and the moisture-absorbent/releasable heat-generating fiber are blended in a prescribed weight ratio. The moisture-absorbent/releasable heat-generating fiber can be dried up to its inherent minimum moisture content, preventing a weight increase, according to the following specific process. To begin, in a carrying step where a moisture-absorbent/releasable heat-generating fiber is carried by a conveyer, it is exposed to hot air and dried up to a minimum moisture content inherent in the moisture-absorbent/releasable heat-generating fiber. Later in the carrying step, the dried moisture-absorbent/releasable heat-generating fiber is exposed to dry air, so that the fiber is cooled on its own in order to develop difficulty in absorbing moisture. Although these steps are sufficient by themselves, the cooled fiber may be compressed with rollers to reduce its surface area where the fiber contacts with the air, thereby developing further difficulty in absorbing moisture. Another applicable process comprises first drying, by heating or with hot air, the moisture-absorbent/releasable heat-generating fiber in a drying furnace and then cooling the fiber inside of the drying furnace with dry air. In this case, the weight is measured in the atmosphere inside the drying furnace.

With respect to the blending of the heat-retaining fiber and the moisture-absorbent/releasable heat-generating fiber in a prescribed weight ratio, it is important that the unstable moisture-absorbent/releasable heat-generating fiber should be both dried and kept with a minimum moisture content, which is inherent in each fiber, and that the heat-retaining fiber and the moisture-absorbent/releasable heat-generating fiber should be blended in a prescribed weight ratio based on their weights in this condition. When the heat-retaining fiber and the moisture-absorbent/releasable heat-generating fiber are blended with the use of a hopper feeder or carding machine, their weights may vary under the influence of humidity. Nevertheless, once the heat-retaining fiber and the moisture-absorbent/releasable heat-generating fiber have been prepared in a prescribed weight ratio, the performance of a resulting intermediate material remains unaffected. Accordingly, the dried heat-retaining fiber and moisture-absorbent/releasable heat-generating fiber can be blended directly by a dry process, or they may be allowed to absorb moisture and blended by a wet process.

The inherent minimum moisture content of the dried fiber indicates a moisture content in the fiber at which equilibrium is established by conducting hot-air drying for a specified time or longer, within a temperature range of not lower than 100° C. and free from such influences as melting of the fiber. The absolute dry condition, where the minimum moisture content is 0%, is an ideal condition but impossible in reality. Thus, any fiber equilibrates at its minimum moisture content when dried at a prescribed temperature for a specified time or longer. Since the moisture-absorbent/releasable heat-generating fiber, in particular, absorbs and releases moisture not only in a large amount but also at a fast rate, it achieves the minimum moisture content after a few minutes of drying to establish equilibrium. For example, a polyacrylate-series moisture-absorbent/releasable heat-generating fiber (N-38, manufactured by Toyobo Co., Ltd.) shows a moisture content of 15% after three minutes of hot-air drying at a temperature of 100 to 120° C., and remains to be in equilibrium at the 15% moisture content, regardless of further continuation of the drying.

Incidentally, some kinds of heat-retaining fibers, which may be dried or not, hardly absorb or release moisture and thus keep their inherent moisture content stable. In this case, the heat-retaining fiber need not be dried intentionally to a minimum moisture content inherent in the fiber in the same manner as the moisture-absorbent/releasable heat-generating fiber. Therefore, in this case, only the moisture-absorbent/releasable heat-generating fiber is dried to a minimum moisture content inherent in the resin, while the heat-retaining fiber can be directly employed without drying.

Here, the heat-retaining fiber and the moisture-absorbent/releasable heat-generating fiber are dried to their inherent minimum moisture contents and then blended in a prescribed weight ratio, based on their weights in this condition. Conversely, it is conceivable that the heat-retaining fiber and the moisture-absorbent/releasable heat-generating fiber may be humidified to their inherent maximum moisture contents and then blended in a prescribed weight ratio based on their weights in this condition. Since the moisture-absorbent/releasable heat-generating fiber, in particular, absorbs and releases moisture not only in a large amount but also at a fast rate, it achieves the maximum moisture content after a humidification time of a few minutes to establish equilibrium. For example, in an atmosphere at a temperature of 20° C. and 95% R.H., a polyacrylate-series moisture-absorbent/releasable heat-generating fiber (N-38, manufactured by Toyobo Co., Ltd.) shows a moisture content of 70% after three minutes, and then equilibrates at the 70% moisture content. In this case, even the same fiber may present different maximum moisture contents, depending on the conditions such as fiber thickness. Nevertheless, whether in a 95% R.H. atmosphere or an atmosphere of the fiber being completely immersed in water, the reference condition observed before the measurement of the fiber weight is stable equilibrium at which the fiber reaches its maximum moisture content in a short time, as in the case of the minimum moisture content. When the moisture-absorbent/releasable heat-generating fiber and the heat-retaining fiber are prepared in a prescribed weight ratio based on their weights at the maximum moisture content, it should be understood that the amount of moisture contained in a fiber differs from fiber to fiber. Namely, between moisture-absorbent/releasable heat-generating fibers with a maximum moisture content of 70% and 200%, there is a significant difference in the amounts of moisture contained in the fibers on their own. For this reason, the reference condition for deciding on the weight ratio should be at the maximum moisture content inherent in the fibers, whereas the weight ratio on its own should be determined in terms of the minimum moisture content inherent in the fibers, allowing for the amount of moisture.

As described above, where the heat-retaining fiber and the moisture-absorbent/releasable heat-generating fiber, each at the maximum moisture content, are blended in a prescribed weight ratio, the blending of the moisture-absorbent/releasable heat-generating fiber and the heat-retaining fiber can be swiftly shifted to a wet process. In addition, regardless of the maximum moisture content, moisture deposited on the moisture-absorbent/releasable heat-generating fiber can be removed, according to calculation formulas or the like, by immersing the fiber in water of given volume and using fundamental data for the fiber and water.

According to the present invention, the moisture-absorbent/releasable heat-generating intermediate material is formed by blending the moisture-absorbent/releasable heat-generating fiber and the heat-retaining fiber, so as to effect sufficient dispersion. For such dispersion, it is desirable to employ a moisture-absorbent/releasable heat-generating fiber which is cut by a cutter of various types. This cutting process can be accomplished by various methods, for example, use can be made of Flock cutter (manufactured by Matsushita Seiki Co., Ltd.). By way of illustration, where feather is blended as the heat-retaining fiber, the moisture-absorbent/releasable heat-generating fiber is cut into a length of 3 to 15 mm, preferably 7 to 10 mm. Then, the feather and the moisture-absorbent/releasable heat-generating fiber are blended according to the dry process or the wet process.

The dry process is a process comprising blending dry feather with a dry moisture-absorbent/releasable heat-generating fiber which is cut into the above cut length. In the manufacture of heat-retaining articles such as clothes or futons, these fibers are enclosed together with compressed air. The fibers used in this process should be dried and dispersed well. Incidentally, although these fibers blend naturally during inclusion, they may be allowed to blend before the inclusion or both before and during the inclusion.

The wet process effects a blending in a feather-washing step, wherein the cut moisture-absorbent/releasable heat-generating fiber is blended into the washing water. In this process, a dispersant (except cation) may be added in order that blending occurs as homogeneously as possible in the water flow.

In both of the above processes, the moisture-absorbent/releasable heat-generating fiber should be dispersed well. This prevents disengagement of a fiber of another species and the cut moisture-absorbent/releasable heat-generating fiber which have been blended, while a produced heat-retaining article is washed or handled in various manners.

To give another example, where sheep wool is blended as the heat-retaining fiber, the moisture-absorbent/releasable heat-generating fiber is employed in a cut length of about 30 to 76 mm. The sheep wool and the moisture-absorbent/releasable heat-generating fiber are blended in a carding machine where they are combed by the card clothing.

The above descriptions relate to blending processes where feather or sheep wool is blended as the heat-retaining fiber. Besides the above processes, there may be additional manners of blending the heat-retaining fiber. For example, the moisture-absorbent/releasable heat-generating fiber may be pulverised and deposited on or filled in gaps in the heat-retaining fiber by static electricity. Alternatively, the moisture-absorbent/releasable heat-generating fiber and the heat-retaining fiber may be made into a conjugate fiber.

In case the bulkiness (air content) deriving from the heat-retaining fiber is highly regarded, the weight ratio of the heat-retaining fiber is raised in the blend of the heat-retaining fiber and the moisture-absorbent/releasable heat-generating fiber.

In correspondence with claim 2 of this application, a moisture-absorbent/releasable heat-generating intermediate material of the present invention is arranged such that the heat-retaining fiber is feather and the moisture-absorbent/releasable heat-generating fiber is of polyacrylate-series, wherein the feather and the moisture-absorbent/releasable heat-generating fiber are prepared in a weight ratio ranging from 9:1 to 6:4, with, at least, the moisture-absorbent/releasable heat-generating fiber being dried to an inherent minimum moisture content, the weight ratio being based on a weight of each of the feather and of the moisture-absorbent/releasable heat-generating fiber respectively in terms of an inherent minimum moisture content, and wherein the moisture-absorbent/releasable heat-generating fiber is homogeneously dispersed in the feather, whereby heat is mainly generated by the moisture absorbent/releasable heat-generating fiber and efficiently retained in the immobile air layer.

With the feather and the moisture-absorbent/releasable heat-generating fiber being dispersed and blended homogeneously, as prepared in the weight ratio of the above range, the moisture-absorbent/releasable heat-generating fiber is entangled with fine fluffs on the surface of the feather and integrated as an intermediate material. This intermediate material effectively allows mainly the moisture-absorbent/releasable heat-generating fiber to absorb moisture vapour (insensible perspiration) or sweat discharged from a human body and to generate heat, and further allows an immobile air layer formed by the feather to take in the thus warmed air, thereby exhibiting a heat-retaining property.

However, where the weight ratio of the feather is less than 6 and the weight ratio of the moisture-absorbent/releasable heat-generating fiber is higher than 4, the moisture-absorbent/releasable heat-generating fiber is not dispersed homogeneously in the feather, with the result that the moisture-absorbent/releasable heat-generating fiber forms lumps. As long as the immobile air layer provided by the feather remains separated from lumps of the moisture-absorbent/releasable heat-generating fiber in this way, the immobile air layer cannot fully exhibit the effects of the moisture-absorbent/releasable heat-generating fiber. Even if the moisture-absorbent/releasable heat-generating fiber is well dispersed in the feather, the absolute amount of feather is too little to secure an immobile air layer for exhibiting the effects of the moisture-absorbent/releasable heat-generating fiber. Consequently, the effects of the moisture-absorbent/releasable heat-generating fiber are saturated.

In contrast, where the weight ratio of the feather is higher than 9 and the weight ratio of the moisture-absorbent/releasable heat-generating fiber is less than 1, the moisture-absorbent/releasable heat-generating fiber is unable to provide sufficient moisture-absorbency/releasability, and the intermediate material becomes bulky.

The foregoing description supports the appropriateness of the above-defined weight ratio range. Compared with an intermediate material made of 100% feather, the intermediate material of the present invention not only achieves 10–30% decrease in bulkiness, but also exhibits excellent effects in terms of warmth, heat-retaining property, dampness, etc. Above all, because of the reduction in bulkiness, sleeping bags and mountaineering wears for severe winter use and futons can be provided with reduced bulkiness as well as excellent mobility and storage property.

Moreover, when the intermediate material is made of the feather and the polyacrylate-series moisture-absorbent/releasable heat-generating fiber as mentioned above, they are preferably blended without using a binder.

Furthermore, the moisture-absorbent/releasable heat-generating heat-retaining article of the present invention comprises an outer material and a lining, each of which has a moisture-permeable/waterproof property, a windproof property and other desired properties, and an intermediate material which is inserted between the outer material and the lining and which has desired properties. This intermediate material applies the intermediate material of the present invention as described above.

As the heat-retaining articles which employ the intermediate material of the present invention, there may be mentioned skiwear, mountaineering wear, winter work clothes, coats, jumpers, windbreakers, sweaters and other clothes for retaining heat, and also sleeping bags, futons, blankets, mattresses, cushions and other bedding, supporters, shoes, socks, gloves, mufflers, caps and the like.

Incidentally, as for sweaters, a base material having a three-layer structure of an outer material, a lining and the intermediate material of the present invention sandwiched in-between, is attached on the reverse side of a commonly used sweater.

BRIEF DESCRIPTION OF DRAWINGS

FIG. 2(*b*) is a perspective view of the test sample.

FIG. 3(*b*) is a perspective view of a test sample using a conventional intermediate material; and FIG. 3(*c*) is a perspective view of a test sample using another conventional intermediate material.

BEST MODE FOR CARRYING OUT THE INVENTION

Preferable embodiments of the present invention are hereinafter described with reference to the attached drawings.

To begin with, various intermediate materials were prepared from an acrylate-series moisture-absorbent/releasable heat-generating fiber (N-38, manufactured by Toyobo Co., Ltd.) and feather (100% down) blended in different weight ratios. The moisture-absorbent/, releasable heat-generating fiber used herein was cut into a length of 7 to 10 mm by Flock cutter (manufactured by Matsushita Seiki Co., Ltd.). The moisture-absorbent/releasable heat-generating fiber and the feather were dried for 30 minutes in a drying furnace at 100° C. and then cooled by substituting the inside of the drying furnace with dry air, so as to bring the moisture contents of the moisture-absorbent/releasable heat-generating fiber and the feather to 15% and 4%, respectively. Their weights were measured in the atmosphere for actual use. Further, the moisture-absorbent/releasable heat-generating fiber and the feather were blended and dispersed well in a dry atmosphere without using a binder, and thus prepared as a homogeneous blend.

Among the obtained intermediate materials, when the weight ratio of the moisture-absorbent/releasable heat-generating fiber was higher than 4 and the weight ratio of the feather was less than 6, the moisture-absorbent/releasable heat-generating fiber formed lumps. Finally, it was impossible to prepare the moisture-absorbent/releasable heat-generating fiber and the feather in a well blended and dispersed state.

Figure 1:
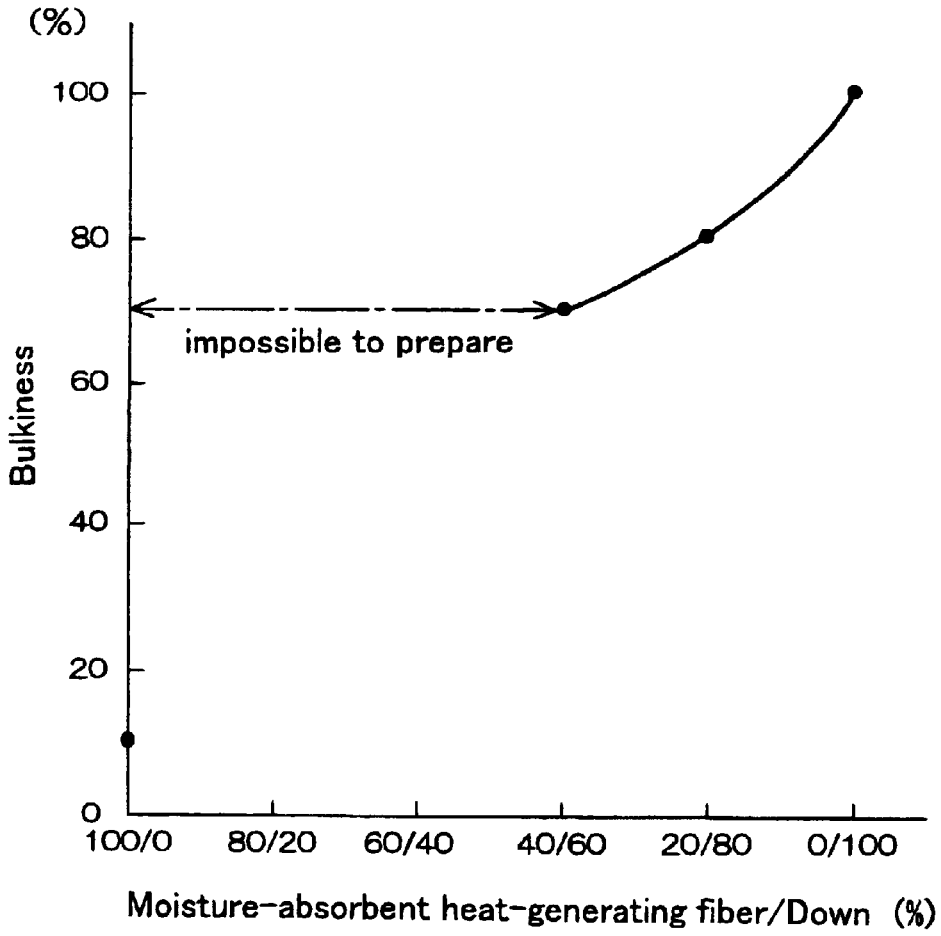
FIG. 1 is a graph showing a relation between the weight ratio of the moisture-absorbent/releasable heat-generating fiber and the feather, versus the bulkiness.

In addition, the intermediate materials (padding), prepared in various ways as above, were measured for their bulkiness. For the bulkiness measurement, 1 g of each of the intermediate materials was put into a 1000-cc graduated cylinder, respectively, and left still for a while. The volume of each intermediate material was measured thereafter. The proportions of the various intermediate materials were calculated, with a proviso that the feather weight ratio of 10 was 100%. FIG. 1 is a graph showing the result. As shown in FIG. 1, the bulkiness decreased incrementally to 70%, while the weight percentage of the moisture-absorbent/releasable heat-generating fiber was raised in a range of from 100% feather to 40:60 by weight (moisture-absorbent/releasable heat-generating fiber:down).

Figure 2:
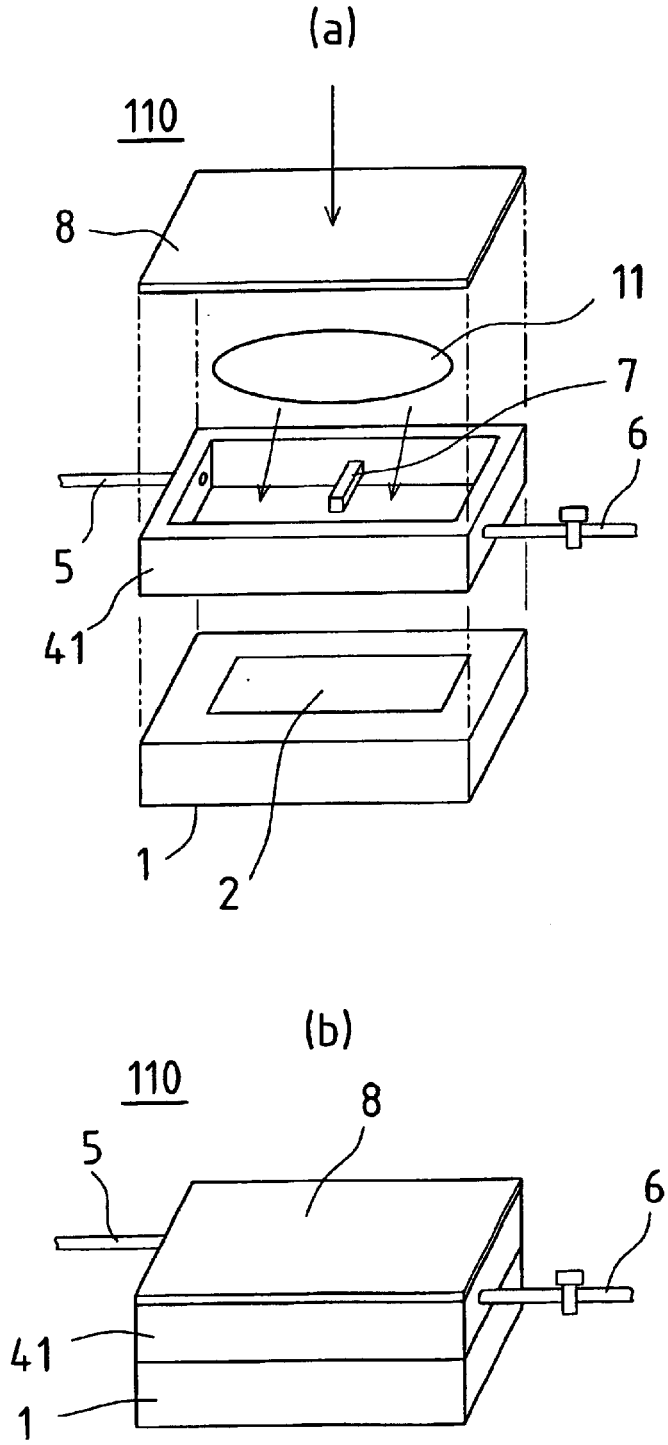
FIG. 2(*a*) is an exploded perspective view of a test sample using a moisture-absorbent/releasable heat-generating intermediate material according to an embodiment of the present invention.
Figure 3:
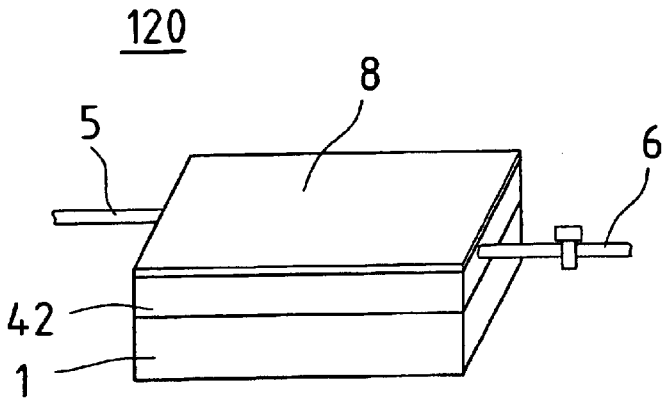
FIG. 3(*a*) is a perspective view of a test sample using a moisture-absorbent/releasable heat-generating intermediate material according to another embodiment of the present invention.
Figure 3:
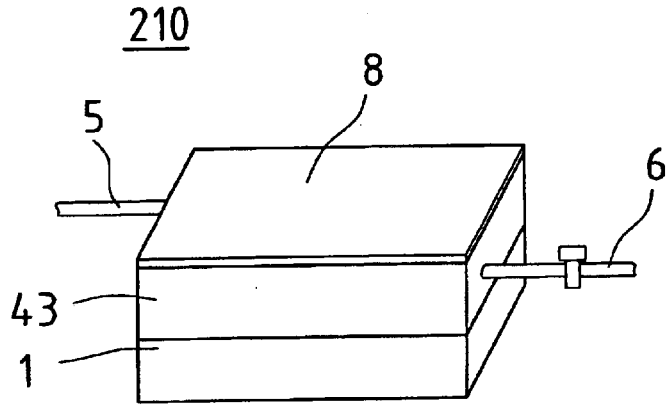
Figure 3:
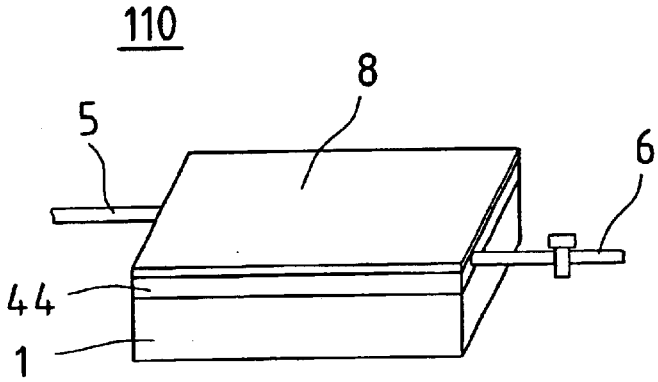

Next, as embodiments of the present invention, test samples 110, 120, 210, 220 shown in FIG. 2 and FIG. 3 were provided, using a total of four kinds of intermediate materials 11, 12, 21, 22. The two intermediate materials 11, 12 were made of the moisture-absorbent/releasable heat-generating fiber and the feather which were blended in ratios of 2:8 and 4:6. The intermediate material 21 was made of 100% of the feather only, while the intermediate material 22 was made of 100% of the above moisture-absorbent/releasable heat-generating fiber only. FIG. 2(*a*) is an exploded perspective view showing the test sample 110 using the intermediate material 11, and FIG. 2(*b*) is a perspective view thereof. FIGS. 3(*a*), (*b*), (*c*) are perspective views showing the test samples 120, 210, 220 using the intermediate materials 12, 21, 22, respectively.

As illustrated in FIG. 2(*a*), the test sample 110 comprises a mount 1 carrying a hot plate 2 (THERMOLABO, manufactured by KATOTECH), a frame 41, and a lid 8 to be laid from above, with the frame 41 containing 1 g of the intermediate material 11. Each of the mount 1, the frame 41 and the lid 8 is made of 5-mm-thick polystyrene foam. The frame 41 is equipped with an air introduction passage 5 and a discharge passage 6 thereof for controlling the temperature and humidity inside the test sample 110, and a temperature/humidity sensor 7 is provided in the test sample 110. The height of the frame 41 is set to 40 mm, in correspondence with the bulkiness shown in FIG. 1. Likewise, as shown in FIG. 3, the frames 42, 43, 44 of the test samples 120, 210, 220 accommodate the intermediate materials 12, 21, 22, respectively, with their heights set to 35 mm, 50 mm and 10 mm, respectively.

Using the test samples 110, 120, 210, 220 obtained in the above manner, experiments were performed to evaluate the performance of each of the intermediate materials 11, 12, 21, 22.

First of all, the intermediate materials 11, 12, 21, 22 in the test samples 110, 120, 210, 220 were dried well, while dry air at 25° C. was fed through the introduction passage 5 of each of the test samples 110, 120, 210, 220, at a flow rate of 10 ml/sec. for five minutes. Then, they went through a moisture-absorbing/heat-generating state, while air at 25° C., 90% R.H. was fed through the introduction passage 5 at a flow rate of 10 ml/sec. for 10 minutes. Thereafter, they were shifted to a moisture-releasing state, while the introduction passage 5 and the discharge passage 6 were left open. For 30 minutes after the start of the experiment, from the dry state through the moisture-absorbing/heat-generating state to the moisture-releasing state, the changes in temperature and humidity were measured with the passage of time by the temperature/humidity sensor 7. The hot plate 2 was set constantly at 30° C. on an assumption that the body temperature is 30° C. The change of the electric power consumption required for maintaining the 30° C. temperature was measured with the passage of time. These results were compiled in FIG. 4 to FIG. 6.

Figure 4:
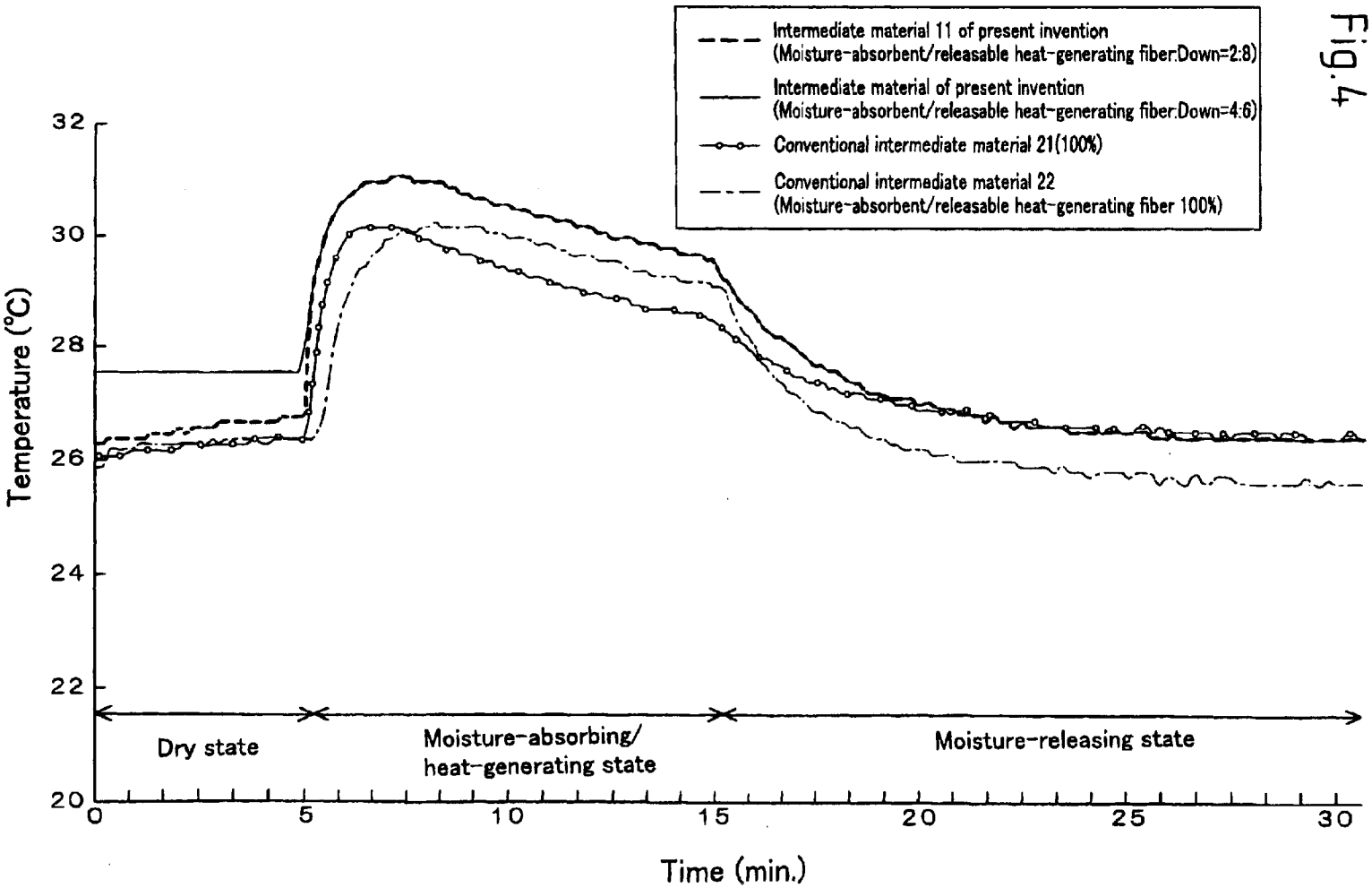
FIG. 4 is a graph showing the temperature change of each of the test samples shown in FIG. 2 and FIG. 3, as measured with the passage of time during the tests using these test samples.

Referring to FIG. 4 showing temperature changes with the passage of time, the intermediate material 11 and the intermediate material 12 of the present embodiment indicate substantially the same temperature rise and temperature drop in the moisture-absorbing/heat-generating state and the moisture-releasing state. Although the intermediate material 11 and the intermediate material 12 show a temperature drop in the moisture-releasing state, they are still capable of keeping substantially the same temperature as the feather intermediate material 21. The conventional intermediate material 22 shows a greater temperature rise in the moisture-absorbing/heat-generating state than the feather intermediate material 21. Nevertheless, its temperature rises slowly at the beginning and drops sharply in the moisture-releasing state. Presumably, the slow start of the temperature rise is caused by lack of sufficient air layer within the intermediate material 22 and the resulting poor flow of humidity. Besides, the sharp temperature drop is probably caused by absence of a sufficient immobile air layer for retaining the heat obtained by the temperature rise.

The above result confirmed that the intermediate materials 11, 12 of the present embodiment were less bulky than the feather intermediate material 21 by as much as 20 to 30% and still provided greater warmth than the 21. Compared with the intermediate material 22 made of the moisture-absorbent/releasable heat-generating fiber, it was also confirmed that the intermediate materials 11, 12 of the present embodiment ensured relatively greater warmth than the intermediate material 22.

Figure 5:
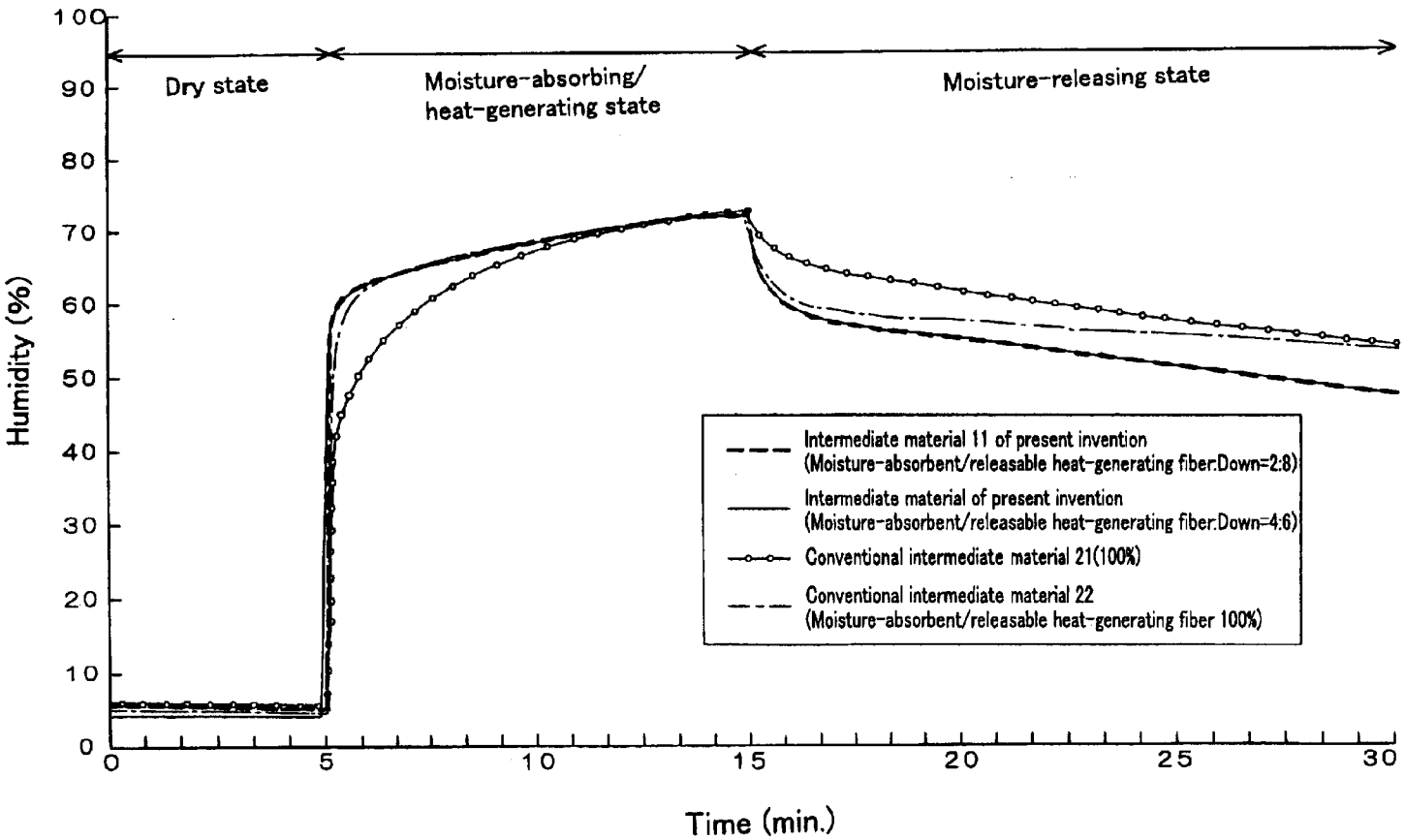
FIG. 5 is a graph showing the humidity change of each of the test samples shown in FIG. 2 and FIG. 3, as measured with the passage of time during the tests using these test samples.

Referring next to FIG. 5 showing humidity changes with the passage of time, the intermediate material 11 and the intermediate material 12 of the present embodiment, as well as the intermediate material 22 made of the moisture-absorbent/releasable heat-generating fiber, indicate substantially the same tracks of change in the moisture-absorbing/heat-generating state. It is confirmed that the feather intermediate material 21 follows substantially the same track as the intermediate materials 11, 12, 13 at a later stage in the moisture-absorbing/heat-generating state, but that it keeps a lower humidity than the intermediate materials 11, 12, 22 at the initial stage in the moisture-absorbing/heat-generating state. This seems to be simply because the air layer within the feather intermediate material 21 is so bulky that it took longer for the humidity rise. In the moisture-releasing state, the intermediate materials 11, 12 of the present embodiment show a sharp humidity drop substantially along the same track. The intermediate material 22 made of the moisture-absorbent/releasable heat-generating fiber marks a sharp humidity drop at the initial stage in the moisture-releasing state, but absence of a sufficient air layer prevents any further notable drop of the humidity. In the meantime, the feather intermediate material 21 shows a gentle track of humidity drop. This is partly because the feather on its own does not discharge the absorbed moisture so positively as the moisture-absorbent/releasable heat-generating fiber, and partly because the air layer within the intermediate material 21 is so bulky.

The above result confirmed that the intermediate materials 11, 12 of the present embodiment showed a better response in absorbing and releasing moisture than the intermediate material 22 made of the moisture-absorbent/releasable heat-generating fiber. Particularly in the moisture-releasing state, they achieved a greater humidity drop than the intermediate material 22 and proved their superior comfortability.

Figure 6:
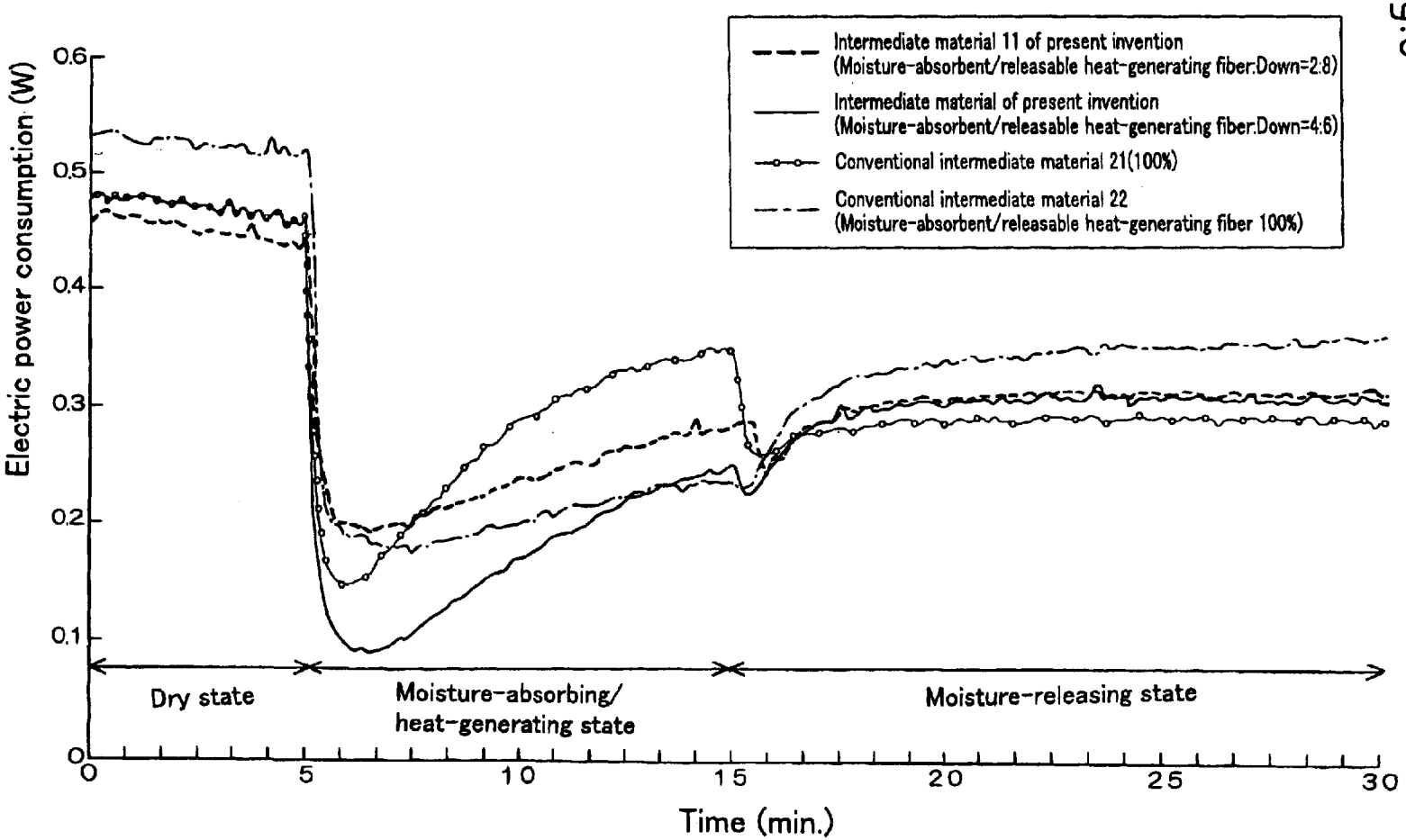
FIG. 6 is a graph showing the change of electric power consumption by each hot plate, as measured with the passage of time during the tests using the test samples shown in FIG. 2 and FIG. 3.

Referring further to FIG. 6 showing electric power consumption with the passage of time, the intermediate material 11 of the present embodiment shows a low electric power consumption in the moisture-absorbing/heat-generating state, where it effects drastic moisture absorption and heat generation and retains the resulting heat in the immobile air layer. The intermediate material 12 of the present embodiment effects drastic moisture absorption and heat generation in the moisture-absorbing/heat-generating state, but shows a greater electric power consumption than the intermediate material 11 because the absolute amount of moisture-absorbent/releasable heat-generating fiber is less than that of the intermediate material 11. At a later stage, however, its electric power consumption does not rise as sharply as the intermediate material 11, because it includes a larger immobile air layer provided by the feather than the intermediate material 11. As for the intermediate material 22 made of the moisture-absorbent/releasable heat-generating fiber, the moisture-absorbing/heat-generating state lasts under the moisture-absorption/release conditions, owing to abundance of the absolute amount of moisture-absorbent/releasable heat-generating fiber. On the other hand, it lacks an immobile air layer for retaining the heat deriving from moisture absorption and heat generation. Roughly taking an average, the track becomes flat. As for the feather intermediate material 21, in which the feather does not have a sufficient moisture-absorbing/heat-generating capacity on its own, the electric power consumption drops temporarily at the initial stage in the moisture-absorbing/heat-generating state, but the electric power consumption increases along with the passage of the time while air at 25° C. continues to be supplied to the intermediate material 21. On the other hand, in the moisture-releasing state where the supply of air at 25° C. is stopped, the feather intermediate material 21, which includes a sufficient immobile air layer for retaining heat, exhibits a heat-retaining capacity. Eventually, its track becomes substantially flat. Likewise, each of the intermediate materials 11, 12, according to the present embodiment, which includes an immobile air layer provided by the feather, exhibits a heat-retaining capacity equivalent to the intermediate material 21 and presents a flat track which is substantially similar to that of the intermediate material 21. In contrast, in the case of the intermediate material 22 made of the moisture-absorbent/releasable heat-generating fiber, the electric power consumption increases sharply in the moisture-releasing state because of absence of an immobile air layer sufficient for retaining the heat deriving from the earlier heat generation.

The above result confirms that the intermediate materials 11, 12 according to the present embodiment are less bulky than the feather intermediate material 21 by as much as 20 to 30% and still ensure a heat-retaining property equivalent to the feather intermediate material 21.

Figure 7:
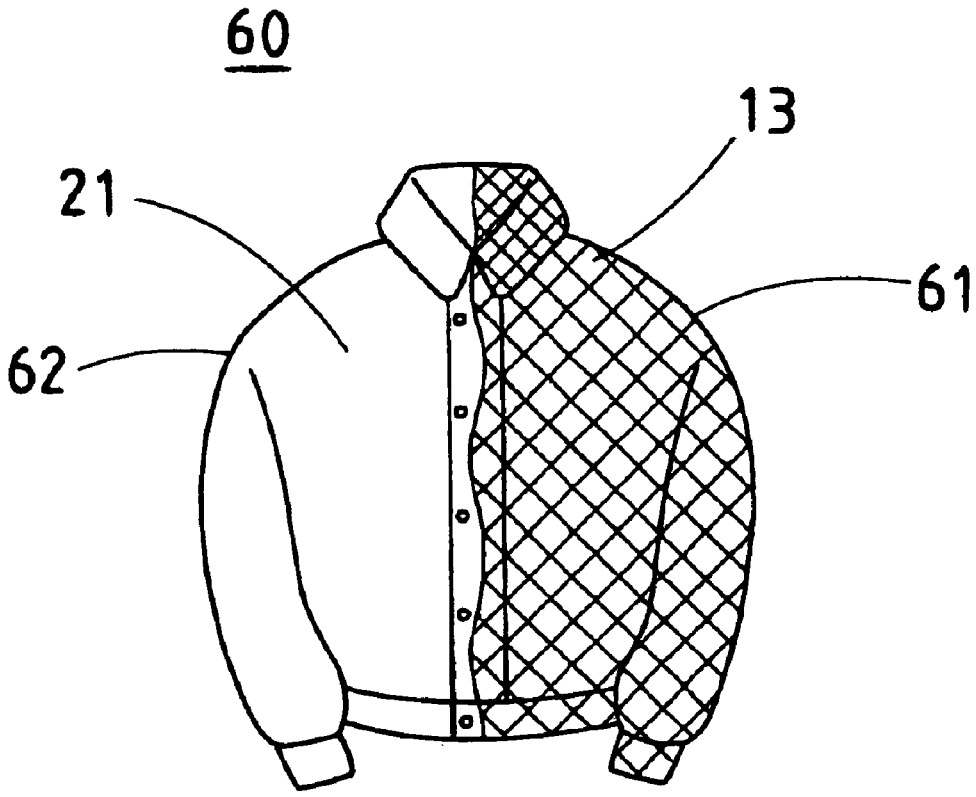
FIG. 7 is a schematic view of a skiwear made of the moisture-absorbent/releasable heat-generating intermediate material according to an embodiment of the present invention and a conventional intermediate material.
Figure 8:
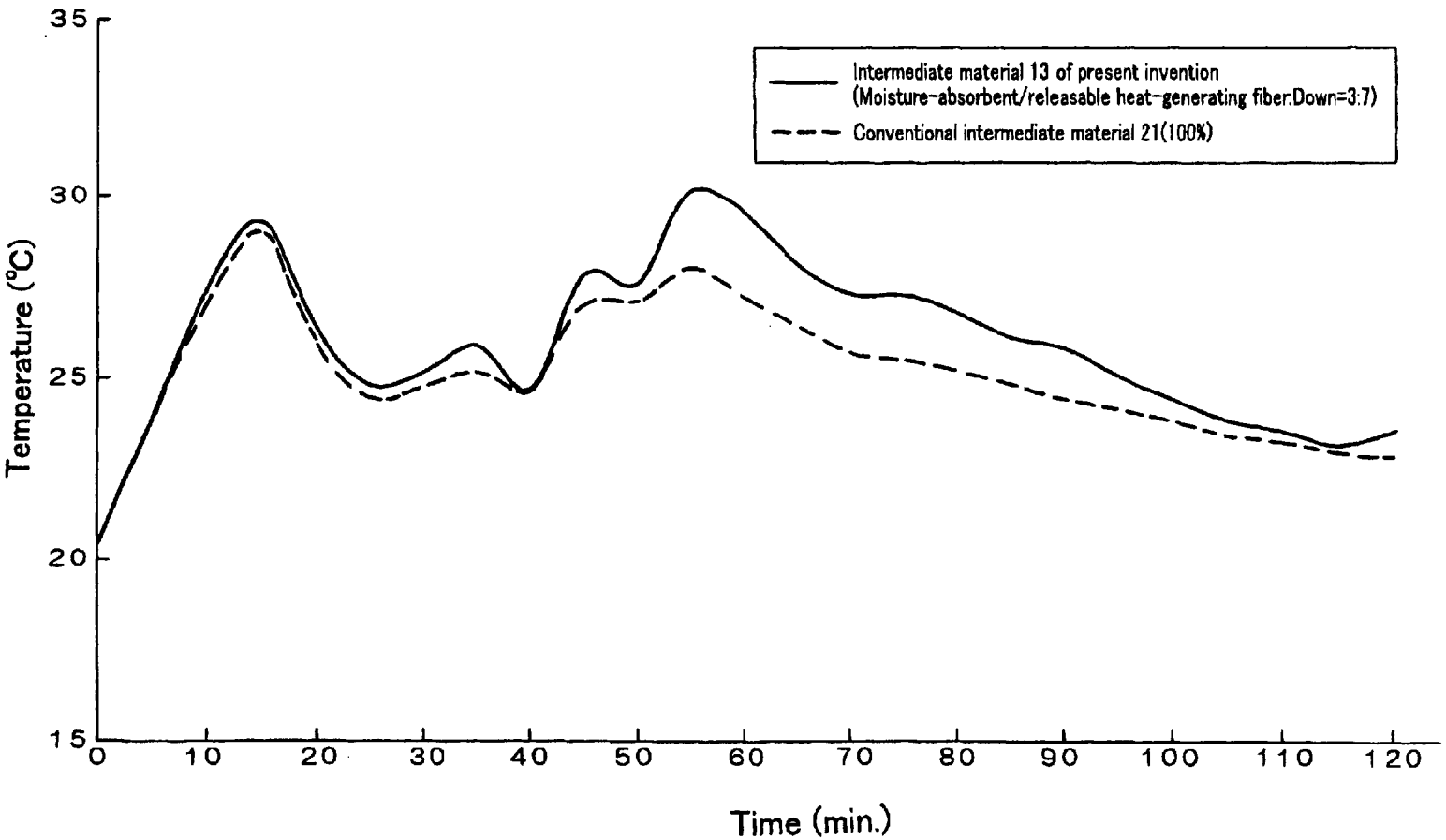
FIG. 8 is a graph showing the temperature change inside each of a moisture-absorbent/releasable heat-generating heat-retaining article according to an embodiment of the present invention and a conventional garment, as measured with the passage of time while each garment is worn.
Figure 9:
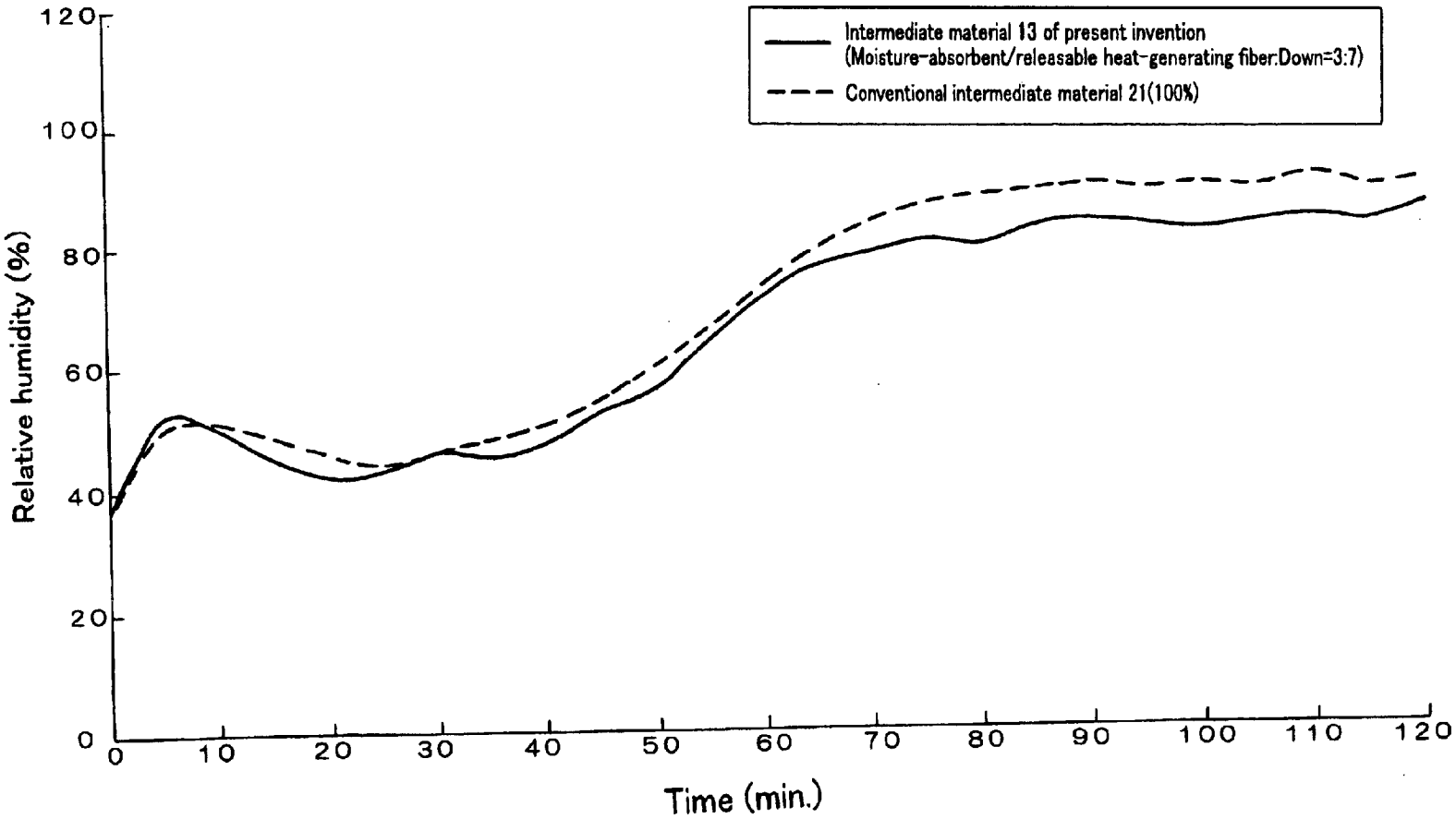
FIG. 9 is a graph showing the humidity change inside each of a moisture-absorbent/releasable heat-generating heat-retaining article according to an embodiment of the present invention and a conventional garment, as measured with the passage of time while each garment is worn.

Next, there were prepared an intermediate material 13 according to the present embodiment comprising the above acrylate-series moisture-absorbent/releasable heat-generating fiber (N-38, manufactured by Toyobo Co., Ltd.) and feather (100% down) which were blended in a weight ratio of 3:7, and a conventional intermediate material 21 comprising feather (100% down). As shown in FIG. 7, a skiwear 60 was manufactured such that a half side 61 of the skiwear 60 was made of the intermediate material 13 of the present embodiment in an amount of 100 g/m$^2$, and another half side 62 was made of the feather intermediate material 21 also in an amount of 100 g/m$^2$. In an experiment, this skiwear 60 was worn during two hours of skiing, and feeling in the garment was evaluated. FIG. 8 and FIG. 9 respectively show the results of the changes in temperature and relative humidity inside the skiwear 60 (between the skiwear 60 and an undershirt) as measured with the passage of time.

Incidentally, the acrylate-series moisture-absorbent/releasable heat-generating fiber (N-38, manufactured by Toyobo Co., Ltd.) and the feather (100% down) were dried for 30 minutes in a drying furnace at 100° C. and then cooled by substituting the inside of the drying furnace with dry air, in which atmosphere their weights were measured to give a weight ratio of 3:7.

The thickness of the half side 61 using the intermediate material 13 of the present embodiment was about three-quarters of that of the half side 62 using the conventional feather intermediate material 21. As a result, in comparison with the half side 62, the half side 61 was light to wear, easy to move the body, excellent in warmth and heat-retaining property, free from dampness in perspiration and therefore comfortable. As apparent from the graphs in FIG. 8 and FIG. 9, the temperature inside the skiwear was warmer in a range from substantially the same to 3.0° C. higher at maximum, and also the humidity inside the skiwear was kept lower in a range of up to 10% at maximum.

What is claimed is:

1. A moisture-absorbent/releasable heat generating material for use in an article of clothing, prepared by a manufacturing process of:

providing a first moisture-absorbing heat generating fiber that comprises a crosslinked acrylic fiber prepared by crosslinking with a nitrogen containing compound and by hydrolysis of uncrosslinked residues; providing a second heat retaining fiber or feather; drying the first fiber to an inherent minimum moisture content; and homogeneously blending the first fiber with the second fiber or feather in a weight ratio of between 1 to 9 and 4 to 6 while the first fiber is at its inherent minimum moisture content.

2. A moisture-absorbent/releasable heat generating material as described in claim 1, wherein feather is blended as the second heat-retaining fiber.

3. A moisture-absorbent releasable heat generating material as described in claim 2, wherein the feather is down.

4. A moisture-absorbent/releasable heat generating material as described in claim 1, wherein drying of the first fiber occurs at a minimum temperature of one hundred degrees centigrade.

5. A moisture-absorbent/releasable heat generating material as described in claim 1, wherein drying of the first fiber occurs by heating or with hot air in a drying furnace and then cooling the fiber inside of the drying furnace with dry air.

6. A moisture-absorbent/releasable heat generating material as described in claim 5, wherein the drying step within the furnace occurs by placing the fiber into the furnace, heating, and then substituting the inside of the drying furnace with dry air.

7. A moisture-absorbent/releasable heat generating material as described in claim 1, wherein prior to homogeneously blending the first fiber and the second fiber or feather, the first fiber is cut into lengths of 3 to 15 mm.

8. A moisture-absorbent/releasable heat generating material as described in claim 1, wherein the first fiber comprises a polyacrylate-series heat generating fiber.

9. A moisture-absorbent/releasable heat generating material as described in claim 1, wherein the first fiber is compressed to reduce its surface area so as to inhibit increase of its moisture absorbing capacity during manufacture prior to homogeneously blending the first fiber with the second fiber or feather.

10. An article of clothing comprising a moisture-absorbent/releasable heat generating material as described in claim 1.

11. A moisture-absorbent/releasable heat generating material for use in an article of clothing, prepared by a manufacturing process of:

providing a first moisture-absorbing heat generating fiber that comprises a crosslinked acrylic fiber prepared by crosslinking with a nitrogen containing compound and by hydrolysis of uncrosslinked residues; providing a second heat retaining fiber or feather; allowing the first fiber to absorb moisture; and homogeneously blending the wet first fiber with the second fiber or feather in a weight ratio of between 1 to 9 and 4 to 6 during a wet process.

12. A moisture-absorbent/releasable heat generating material as described in claim 11, wherein feather is blended as the second heat-retaining fiber.

13. A moisture-absorbent/releasable heat generating material as described in claim 11, wherein the first fiber and the second fiber or feather are humidified to their inherent maximum moisture contents prior to blending.

14. A moisture-absorbent/releasable heat generating material as described in claim 11, wherein humidification of the first fiber occurs by complete immersion in water.

15. A moisture-absorbent/releasable heat generating material as described in claim 12, wherein the feather is washed in water and the first fiber is blended into the feather washing water.

16. A moisture-absorbent/releasable heat generating material as described in claim 15, wherein a non-cationic dispersant is added to facilitate homogeneous blending.

17. A moisture-absorbent/releasable heat generating material as described in claim 11, wherein prior to homogeneously blending the first fiber and the second fiber or feather, the first fiber is cut into lengths of 3 to 15 mm.

18. A moisture-absorbent/releasable heat generating material as described in claim 11, wherein sheep wool is blended as the heat-retaining fiber.

19. An article of clothing comprising a moisture-absorbent/releasable heat generating material as described in claim 11.

20. A moisture-absorbent/releasable heat generating material for use in an article of clothing, prepared by a manufacturing process of:

providing a dried, pulverized first moisture-absorbing heat generating fiber that comprises a crosslinked acrylic fiber prepared by crosslinking with a nitrogen containing compound and by hydrolysis of uncrosslinked residues; providing a second heat retaining fiber or feather; and depositing or filling in gaps in the second heat retaining fiber or feather with the pulverized first moisture-absorbing heat generating fiber by static electricity.

* * * * *

UNITED STATES PATENT AND TRADEMARK OFFICE

CERTIFICATE OF CORRECTION

PATENT NO. : 6,802,081 B1
DATED : October 12, 2004
INVENTOR(S) : Takeshi Ogino et al.

It is certified that error appears in the above-identified patent and that said Letters Patent is hereby corrected as shown below:

Title page,
Item [86], PCT No., change "PCT/JP99/02827" to -- PCT/JP98/02827 --.

Signed and Sealed this

Eighth Day of February, 2005

JON W. DUDAS
*Director of the United States Patent and Trademark Office*

UNITED STATES PATENT AND TRADEMARK OFFICE

CERTIFICATE OF CORRECTION

PATENT NO. : 6,802,081 B1
APPLICATION NO. : 09/485675
DATED : September 23, 2004
INVENTOR(S) : Ogino et al.

It is certified that error appears in the above-identified patent and that said Letters Patent is hereby corrected as shown below:

On the title page, (73) Assignee, add the following Assignee: --Nihon Deshikanto Kabushiki Kaisha, Osaka (JP)--.

On the title page, under (86), please replace "PCT/JP99/02827" with --PCT/JP98/02827--.

Signed and Sealed this

Fifth Day of September, 2006

JON W. DUDAS
*Director of the United States Patent and Trademark Office*

UNITED STATES PATENT AND TRADEMARK OFFICE

CERTIFICATE OF CORRECTION

PATENT NO. : 6,802,081 B1
APPLICATION NO. : 09/485675
DATED : October 12, 2004
INVENTOR(S) : Ogino et al.

It is certified that error appears in the above-identified patent and that said Letters Patent is hereby corrected as shown below:

On the title page, (73) Assignee, add the following Assignee: --Nihon Deshikanto Kabushiki Kaisha, Osaka (JP)--.

On the title page, under (86), please replace "PCT/JP99/02827" with --PCT/JP98/02827--.

This certificate supersedes Certificate of Correction issued September 5, 2006.

Signed and Sealed this

Seventh Day of November, 2006

JON W. DUDAS
*Director of the United States Patent and Trademark Office*